US006663354B2

(12) United States Patent
Forster

(10) Patent No.: US 6,663,354 B2
(45) Date of Patent: Dec. 16, 2003

(54) HYDROSTATIC AXIAL PISTON MACHINE WITH A CONTROL PORT, A CRADLE SUPPORTED SWASHPLATE AND A SWASHPLATE ACTUATING PISTON

(75) Inventor: Franz Forster, Karlstadt-Mühlbach (DE)

(73) Assignee: Linde Aktiengesellschaft (DE)

( * ) Notice: Subject to any disclaimer, the term of this patent is extended or adjusted under 35 U.S.C. 154(b) by 0 days.

(21) Appl. No.: 10/002,955

(22) Filed: Nov. 2, 2001

(65) Prior Publication Data

US 2002/0106284 A1 Aug. 8, 2002

(30) Foreign Application Priority Data

Nov. 8, 2000 (DE) ..... 100 55 262

(51) Int. Cl.[7] ..... F04B 1/26

(52) U.S. Cl. ..... 417/222.1; 417/269; 417/212; 417/319; 91/473; 91/499; 92/71; 92/12.2; 92/19; 60/442

(58) Field of Search ..... 417/269, 212, 417/319, 223, 217, 222.1; 91/473, 499, 506, 503, 505, 484; 92/71, 12.2, 19, 20, 24; 60/442, 487

(56) References Cited

U.S. PATENT DOCUMENTS

| | | | | | |
|---|---|---|---|---|---|
| 3,661,055 | A | * | 5/1972 | Pruvot | 91/486 |
| 3,739,692 | A | * | 6/1973 | Bell | 91/506 |
| 4,449,444 | A | * | 5/1984 | Forster | 91/506 |
| 4,515,067 | A | * | 5/1985 | Heyl | 91/506 |
| 4,543,876 | A | * | 10/1985 | Heyl et al. | 91/506 |
| 4,615,257 | A | * | 10/1986 | Valentin | 91/499 |
| 4,903,577 | A | * | 2/1990 | Loffler | 91/488 |
| 5,226,349 | A | * | 7/1993 | Alme et al. | 91/506 |
| 5,636,561 | A | * | 6/1997 | Pecorari | 91/499 |
| 5,730,043 | A | * | 3/1998 | Kristensen et al. | 92/57 |
| 5,738,000 | A | * | 4/1998 | Forster | 92/165 R |
| 5,752,428 | A | * | 5/1998 | Jepsen | 91/499 |
| 6,186,046 | B1 | * | 2/2001 | Allart et al. | 91/491 |
| 6,283,721 | B1 | * | 9/2001 | Gollner | 417/222.1 |
| 6,287,086 | B1 | * | 9/2001 | Steen | 417/269 |
| 6,336,323 | B1 | * | 1/2002 | Tanabe et al. | 60/442 |
| 6,510,779 | B2 | * | 1/2003 | Greene et al. | 91/504 |

FOREIGN PATENT DOCUMENTS

DE 196 42 022 A1 1/1998

* cited by examiner

*Primary Examiner*—Charles G. Freay
*Assistant Examiner*—Emmanuel Sayoc
(74) *Attorney, Agent, or Firm*—Webb Ziesenheim Logsdon Orkin & Hanson, P.C.

(57) ABSTRACT

A hydrostatic axial piston machine has a cylinder block with bores holding reciprocating pistons, a swashplate supporting the pistons, and control cams to supply the bores with hydraulic fluid. The swashplate is a pivoting cradle mounted on friction bearings in a cradle receptacle. Hydraulic fluid channels empty into the cradle receptacle and are in communication with supply channels in the cradle connected to the control cams. An actuator piston to adjust the cradle is located between two friction bearing segments of the cradle receptacle and has a toothed rack segment engaging a gearing segment on the back side of the cradle.

18 Claims, 2 Drawing Sheets

HYDROSTATIC AXIAL PISTON MACHINE WITH A CONTROL PORT, A CRADLE SUPPORTED SWASHPLATE AND A SWASHPLATE ACTUATING PISTON

CROSS-REFERENCE TO RELATED APPLICATION

This application corresponds to German Application No. 100 55 262.5 filed Nov. 8, 2000, herein incorporated by reference in its entirety.

BACKGROUND OF THE INVENTION

1. Field of the Invention

This invention relates generally to axial piston machines and, more particularly, to a hydrostatic axial piston machine having a cylinder block in which there are bores to hold reciprocating pistons, and with a swashplate on which the reciprocating pistons are supported and in which there are control ports to supply the bores with hydraulic medium.

2. Technical Considerations

DE 196 42 022 A1 describes an axial piston machine. The field of application of the machine disclosed therein, with a control system and hydraulic fluid supply system in the swashplate, is limited because the intake and delivery volume is constant.

It is an object of the present invention to provide an axial piston machine of the general type described above but with an expanded range of potential applications.

SUMMARY OF THE INVENTION

The invention provides an axial piston machine in which the swashplate is adjustable. It thereby becomes possible to increase the transformation range of a hydrostatic transmission in which the axial piston machine of the invention is used by regulating not only the primary side (i.e., adjustment of the delivery volume of the pump) but also the secondary side (i.e., adjustment of the intake volume of the motor).

In one advantageous configuration of the invention, the swashplate includes a pivoting cradle mounted in friction bearings in a cradle receptacle. Hydraulic fluid channels empty into the cradle receptacle and, regardless of the rotational position of the cradle, are in connection with feed channels in the cradle that are connected to control ports. The bores in the cylinder block are, therefore, supplied with hydraulic fluid via the adjustable cradle. As a result of the hydraulic fluid channels that emerge in the cradle receptacle, the friction bearing system of the cradle can also be pressurized with hydraulic fluid to achieve a hydrostatic relief of the cradle.

Pivot means can be provided to pivot the cradle. The pivot means can comprise an actuator piston that is oriented substantially perpendicular to the axis of rotation of the cylinder block and substantially perpendicular to the axis of rotation of the cradle and that is actively connected with the cradle. If the actuator piston has a toothed rack segment that engages a toothed segment on the back side of the cradle, there is a constructively simple and functionally reliable active connection between the actuator piston and the cradle in which the actuator piston is tangentially engaged with the back side of the cradle.

The invention teaches that it is appropriate if the actuator piston is located between two friction bearing segments of the cradle receptacle and is centered with respect to the cradle.

The cylinder block advantageously has an external bearing system. An external bearing system minimizes the dimensions of the axial piston machine of the invention in the radial direction. In this case, it is advantageous if the cylinder block bearing system has two helical roller bearings in an O-arrangement.

In one particularly advantageous configuration of the invention, the axial piston machine is configured as a hub drive, in particular a wheel hub drive, whereby the cylinder block forms a rotating hub, a housing that surrounds the cylinder block serves as the hub carrier, and the cylinder block bearing system is realized in the form of a hub bearing system. The cylinder block can include a wheel fastening flange and a rim centering device.

In an additional advantageous configuration of the invention, a brake is connected between the cylinder block and the housing. The brake can be a wet-running, hydraulically-relieved, spring-loaded, multiple-disc brake. In this case, the brake can be cooled by hydraulic fluid, as a result of which it can absorb a high braking power.

BRIEF DESCRIPTION OF THE DRAWINGS

Additional advantages and features of the invention are explained in greater detail below with reference to the exemplary embodiment of the invention illustrated in the accompanying schematic drawings, in which:

In FIG. 1, the cradle 7 is in position other than the minimum position.

FIG. 2 is a cross section through the axial piston machine, illustrated in FIG. 1, taken along line II—II in FIG. 1 in the area of the cradle receptacle.

DESCRIPTION OF THE PREFERRED EMBODIMENT

Figure 1:
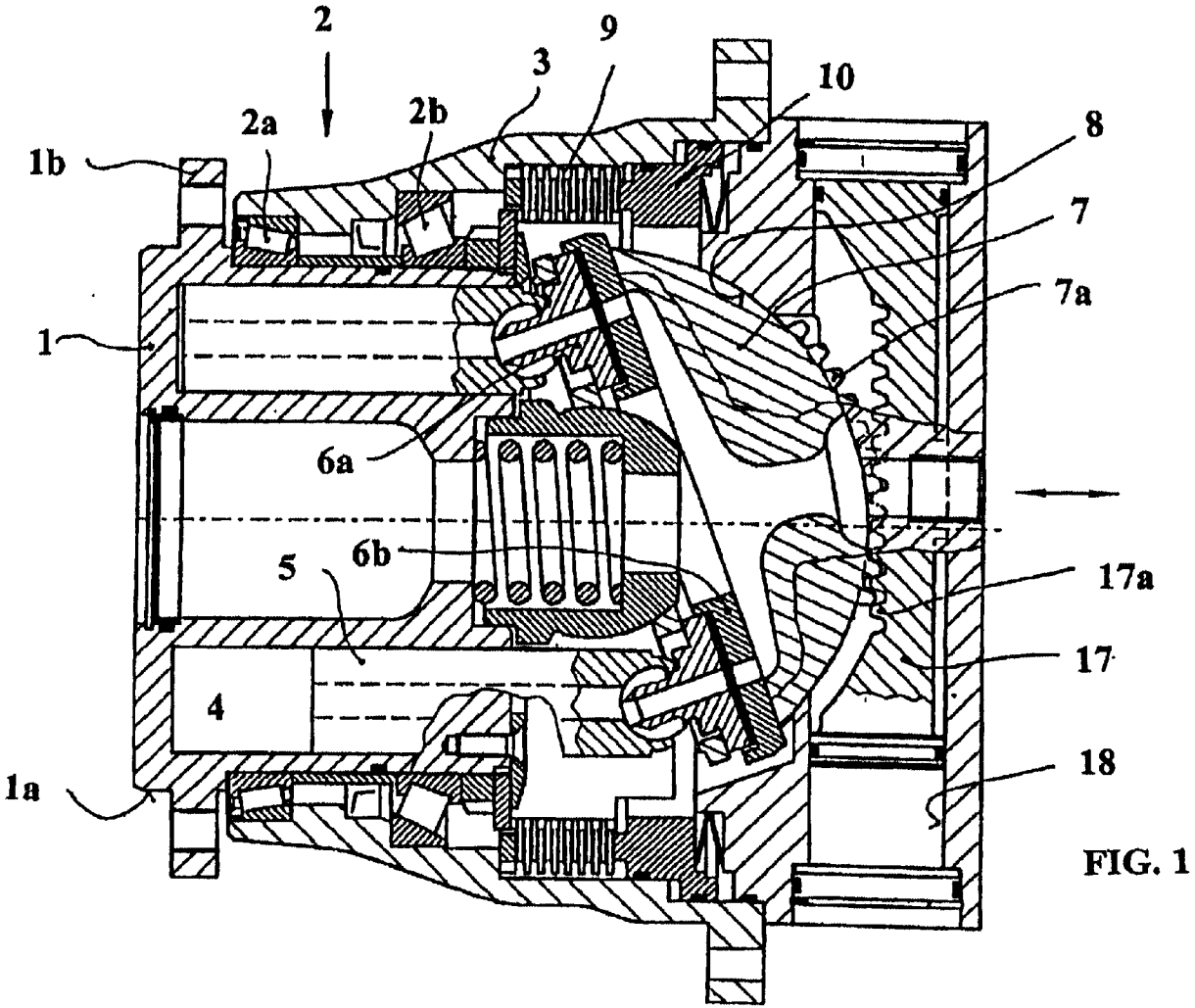
FIG. 1 is a longitudinal section through a hydrostatic axial piston machine of the invention taken along the line I—I in FIG. 2.
Figure 2:
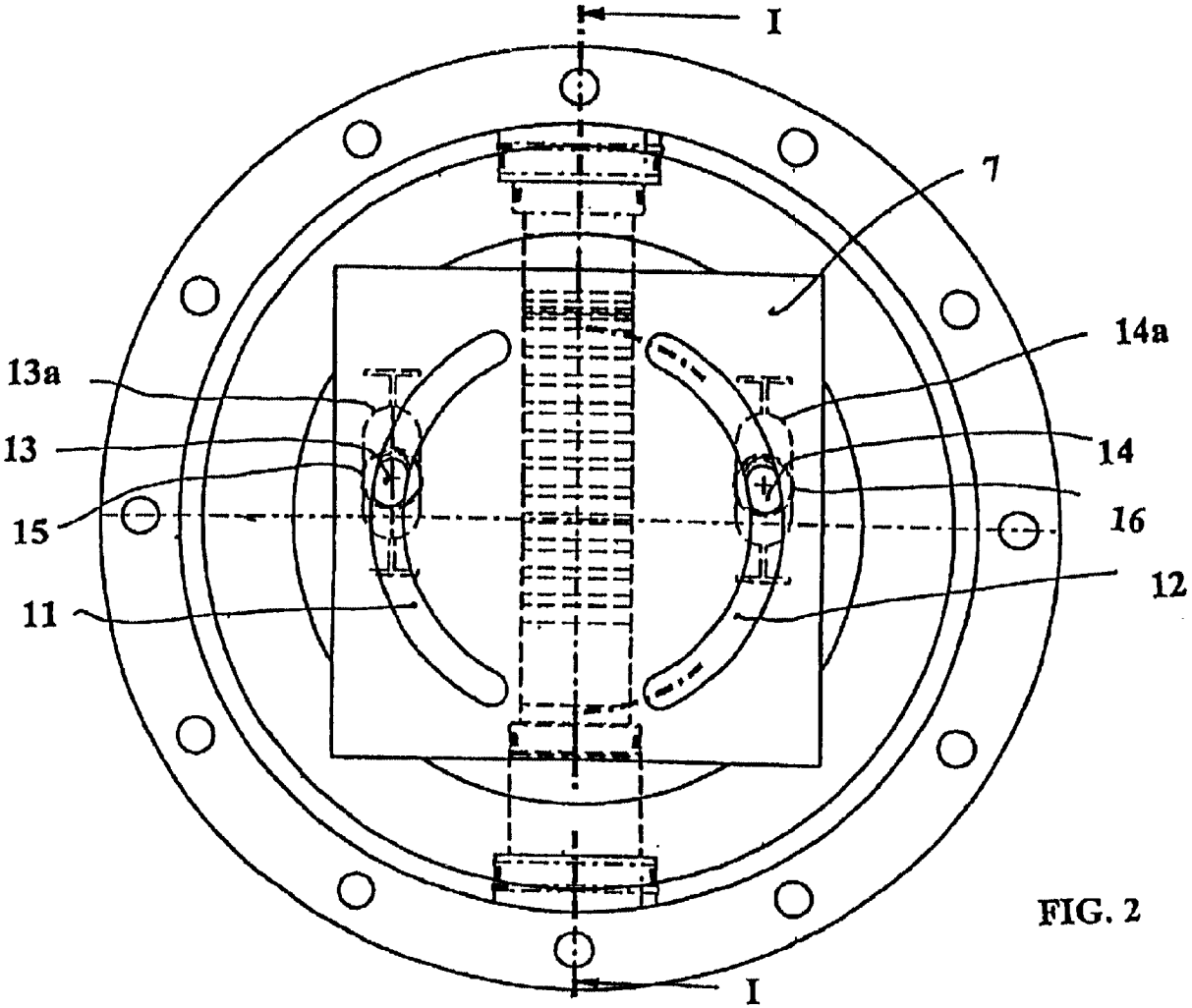
In FIG. 2, the cradle 7 is in the minimum position in which the pistons located in the cylinder drum have their minimum stroke, e.g., zero stroke.

In the exemplary embodiment shown in FIGS. 1 and 2, the hydrostatic axial piston machine of the invention is in the form of a wheel hub motor. However, it is to be understood that the invention is not limited to use as a wheel hub motor. As shown in FIG. 1, a cylinder block 1 forms a rotating hub and is rotationally mounted by means of a cylinder block bearing system 2 that acts as a hub bearing system in a surrounding housing 3 which performs the function of a hub carrier. The cylinder block bearing system 2 includes two bearing assemblies which include helical roller bearings 2*a* and 2*b*, e.g., conical roller bearings, in an O-arrangement, e.g., the bearing 2*a* is mounted between an outer ring 2*aa* and an inner ring 2*ab*, and the bearing 2*b* is mounted between an outer ring 2*ba* and an inner ring 2*bb*.

A rim centering device 1*a* and a wheel fastening flange 1*b* are shaped onto the cylinder block 1 for holding and fastening at least one wheel rim. In the cylinder block 1, there are a plurality of concentric bores 4 in each of which a reciprocating piston 5 can move longitudinally. The pistons 5 are supported by means of a slipper 6*a* and an annular disc 6*b* on a swashplate that is configured in the form of a cradle 7. The cradle 7 is mounted on friction bearings 7*b* (shown only in FIG. 2) in a cradle receptacle 8 which is located in a closing cover that is connected with the housing 3.

Between the cylinder block 1 and the housing 3, there is a wet-running, spring-loaded, multiple-disc brake 9. The brake 9 can be released by means of a hydraulically pressurized annular piston 10. The invention teaches that the bores 4 are supplied with hydraulic medium via the adjustable cradle 7 and the cradle receptacle 8. For this purpose, the cradle 7 is provided on its end surface facing the reciprocating pistons 5 with control ports 11, 12 (FIG. 2), each of which is connected to a respective supply channel 13, 14 in the cradle 7.

The supply channels 13, 14 each end at the back side of the cradle 7 in groove-shaped expanded channels 13*a* and 14*a*, respectively, which are located in the area of a friction bearing segment of the cradle receptacle 8. The expanded channels 13*a* and 14*a* ensure that, regardless of the position of the pivoting cradle 7, the supply channels 13, 14 are always connected with hydraulic fluid connecting channels 15 and 16, respectively, which empty in the cradle receptacle 8. Hydraulic fluid travels via channels in the annular disc 6*b*, the slippers 6*a*, and the reciprocating pistons 5 into the bores 4 of the cylinder block 1, and is also discharged via the same path.

The friction bearing segments of the cradle receptacle 8 are also supplied with hydraulic fluid by the hydraulic fluid connecting channels 15 and 16 to achieve a hydrostatic relief of the cradle 7.

Between two parallel friction bearing segments of the cradle 7, there is a central gearing segment 7*a* on the back side of the cradle 7 for adjustment of the cradle 7 in the cradle receptacle 8. The gearing 7*a* interacts with a toothed rack segment 17*a* of an actuator piston 17 that is oriented perpendicular to the axis of rotation of the cylinder block 1 and perpendicular to the axis of rotation of the cradle 7. The double-acting actuator piston 17, which is located in a bore 18 of the cradle receptacle 8, is centrally located with reference to the cradle 7 (FIG. 2). The actuator piston 17 is, therefore, located between the two friction bearing segments of the cradle receptacle 8.

In this exemplary embodiment, the cradle 7 of the axial piston machine pivots only to one side. The axial piston machine can thereby be set from a maximum intake volume to a minimum intake volume and back again. However, it is also possible to equip the axial piston machine with a cradle 7 that pivots to both sides, in which case the axial piston machine would be reversible (change in direction of rotation).

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A hydrostatic axial piston machine, comprising:

a cylinder block having bores with reciprocating pistons, wherein each piston has a passageway; and a swashplate on which the reciprocating pistons are supported and in which there are control ports to control supply of hydraulic fluid between the swashplate and the passageway of each piston to supply hydraulic fluid to its respective bore, wherein the swashplate is adjustable.

2. The hydrostatic axial piston machine as claimed in claim 1, wherein the swashplate is a pivoting cradle mounted on friction bearings in a cradle receptacle, wherein hydraulic fluid channels empty in the cradle receptacle and, regardless of the rotational position of the cradle, are in communication with supply channels in the cradle which are connected to the control ports.

3. A hydrostatic axial piston machine, comprising:

a cylinder block having bores with reciprocating pistons;

a swashplate on which the reciprocating pistons are supported and in which there are control ports to supply the bores with hydraulic fluid, wherein the swashplate is adjustable and is a pivoting cradle mounted on friction bearings in a cradle receptacle, wherein hydraulic fluid channels empty in the cradle receptacle and, regardless of the rotational position of the cradle, are in communication with supply channels in the cradle which are connected to the control ports; and means to pivot the cradle, wherein the pivot means comprise an actuator piston that is substantially perpendicular to an axis of rotation of the cylinder block and substantially perpendicular to an axis of rotation of the cradle and is connected with the cradle.

4. The hydrostatic axial piston machine as claimed in claim 3, wherein the actuator piston has a toothed rack segment which is engaged with a gearing segment on a back side of the cradle.

5. The hydrostatic axial piston machine as claimed in claim 3, wherein the actuator piston is located between two friction bearing segments of the cradle receptacle with middle point of the actuating piston and middle point of the cradle in a predetermined relationship with one another.

6. The hydrostatic axial piston machine as claimed in claim 1, wherein the cylinder block includes an external bearing system.

7. The hydrostatic axial piston machine as claimed in claim 1, including a cylinder block bearing system with two bearing assemblies, each of the bearing assemblies including roller bearings mounted between an outer ring and an inner ring.

8. The hydrostatic axial piston machine as claimed in claim 1, wherein the axial piston machine is a hub drive in which the cylinder block is a rotating hub, a housing that surrounds the cylinder block is a hub carrier, and a cylinder block bearing system is a hub bearing system.

9. The hydrostatic axial piston machine as claimed in claim 8, wherein the cylinder block includes a wheel fastening flange and a rim centering device.

10. The hydrostatic axial piston machine as claimed in claim 1, including a housing and a brake connected between the cylinder block and the housing.

11. The hydrostatic axial piston machine as claimed in claim 10, wherein the brake is a hydraulically-relieved, spring-loaded, multiple-disc brake.

12. The hydrostatic axial piston machine as claimed in claim 4, wherein the actuator piston is located between two friction bearing segments of the cradle receptacle with middle point of the actuating piston and middle point of the cradle in a predetermined relationship with one another.

13. The hydrostatic axial piston machine as claimed in claim 8, wherein the hub drive is a wheel hub drive.

14. The hydrostatic axial piston machine as claimed in claim 2, including means to pivot the cradle, wherein the pivot means comprise an actuator piston that is substantially perpendicular to an axis of rotation of the cylinder block and substantially perpendicular to an axis of rotation of the cradle and is connected with the cradle.

15. The hydrostatic axial piston machine as claimed in claim 14, wherein the actuator piston has a toothed rack segment which is engaged with a gearing segment on a back side of the cradle.

16. The hydrostatic axial piston machine as claimed in claim 14, wherein the actuator piston is located between two friction beam segments of the cradle receptacle with middle point of the actuating piston and middle point of the cradle in a predetermined relationship with one another.

17. The hydrostatic axial piston machine as claimed in claim 15, wherein the actuator piston is located between two friction bearing segments of the cradle receptacle with middle point of the actuating piston and middle point of the cradle in a predetermined relationship with one another.

18. The hydrostatic axial piston machine as claimed in claim 1, wherein the bores have a first end and an opposite second end, with the first end being a closed end and the second end being an open end to receive its respective piston.

* * * * *